United States Patent [19]

Herner

[11] Patent Number: 4,726,393

[45] Date of Patent: Feb. 23, 1988

[54] POWER VALVE ASSEMBLY

[75] Inventor: Ray H. Herner, Brookville, Ohio

[73] Assignee: Mosier Industries, Inc., Brookville, Ohio

[21] Appl. No.: 892,096

[22] Filed: Jul. 31, 1986

[51] Int. Cl.[4] ..... F15B 13/043

[52] U.S. Cl. ..... 137/269; 137/625.64; 137/884; 251/26

[58] Field of Search ..... 137/269, 271, 625.6, 137/625.64, 884; 251/26

[56] References Cited

U.S. PATENT DOCUMENTS

| | | | |
|---|---|---|---|
| 3,101,741 | 8/1963 | Ludwig | 137/625.6 |
| 3,171,435 | 3/1965 | Lansky et al. | 137/596.16 |
| 3,215,158 | 11/1965 | Bass et al. | 137/269 |
| 3,467,222 | 9/1969 | Gruber | 137/271 X |
| 3,487,848 | 1/1970 | Leibfritz et al. | 137/625.64 X |
| 3,513,876 | 5/1970 | Tarboy | 137/269 X |
| 3,540,480 | 11/1970 | Leibfritz et al. | 137/625.6 |
| 3,618,631 | 11/1971 | Jeans et al. | 137/271 X |
| 3,902,526 | 9/1975 | Brake et al. | 137/625.64 |
| 4,082,108 | 4/1978 | Dininio | 137/271 X |
| 4,524,803 | 6/1985 | Stoll et al. | 137/625.64 |

*Primary Examiner*—Gerald A. Michalsky
*Attorney, Agent, or Firm*—Jerome P. Bloom

[57] ABSTRACT

This invention relates to power valve assemblies and systems thereof and more particularly to their controls. It features a body having flow passages through which control fluid is directed to operate the interrelated valve. Said body is constructed to provide therein a plurality of openings or cavities each of which intersect one or more of said flow passages. Per the present invention, a plurality of unique independent adapters or control units are provided for application to said openings or cavities. Said adapters and/or control units are so designed that each thereof has different form and utility, may be selectively applied to said openings or cavities and easily and quickly interchanged or shifted from one thereof to another by virtue of which to influence the delivery and mode of application of control fluid and thereby the means and/or mode of control of the operation of the valve to which they relate. A preferred embodiment of the invention provides a simplistic compact valve assembly wherein said body serves in part as the base of a directional control valve with which it functionally interrelates to direct working fluid to and from a designated point of use. In any case the construction and arrangement insures a physical divorce of controls and attachments required for operation of a valve from the body of the valve per se.

22 Claims, 20 Drawing Figures

POWER VALVE ASSEMBLY

BACKGROUND OF THE INVENTION

Power valve assemblies and systems of the prior art have exhibited a number of undesirable characteristics and presented various problems in their construction, assembly and use. Most of these stem from the complexity of their design, the lack of comprenhesive attention therein to safety in their use, the cluttered and less than convenient mode of interrelation of their parts, the inherent demand for their frequent inspection and maintenance procedures and particularly from the means and manner of the embodiment of their essential controls.

All of the foregoing problems and objectionable characteristics are solved and/or eliminated in the application and use of the improvements of the present invention.

This invention relates to fluid power systems in general and more particularly to a new and improved power valve assembly and power valve system which as contrasted to those of the prior art is more economical to fabricate, free of complexity as to the construction, assembly, relation and interaction of its component parts, affords maximum protection against electrical hazard in its installation, maintenance and use and presents a system wherein the means and/or mode of control of a given valve may be quickly and easily changed.

Embodiments of the invention feature a new and improved base which is very simply constructed and arranged to mount not only the interrelated valve but also, in a physically separated relation thereto, those elements which determine its mode of control and the source of the power necessary for its operation.

Preferred embodiments not only provide a new and improved base for directional control and other multifunction valves which is simply constructed and arranged to mount the interrelated valve and physically divorce therefrom those elements which determine its mode of control and operation but also, in combination therewith, a plurality of quick fit, interchangeable adapters serving as optional control members which may be selectively applied to the base in a manner to facilitate a quick interchange of their positions or interchange thereof per se to quickly and easily change or modify the mode of control and operation of the interrelated valve.

As will be seen, the use of the invention base facilitates a power valve assembly or system which not only has versatility as to its application and mode of control but also a capability of assured and continuing effective performance, the degree and extent of which is beyond that comprehended in the prior art. The benefits and advantages of the invention should be more clearly apparent from the following detailed disclosure of illustrative embodiments.

Neither the inventor nor any of those substantially involved in this disclosure are aware of any prior art which is specifically pertinent to the many points of novelty which are herein set forth and particularly claimed.

SUMMARY OF THE INVENTION

Embodiments of a power valve assembly and system per the present invention comprise a power valve unit, a valve base and a plurality of control elements which serve as the essential parts of the valve control system.

The latter are physically divorced from the valve and mount solely to the valve base. The valve base per se is a new and improved structure which is simplistically but effectively designed for a quick and easy selective interfit thereto of said control elements, which per the present invention have different form and utility.

Preferred embodiments of the invention feature a valve base distinguished by a plurality of cavities which selectively accommodate selected control elements which may be easily and quickly interchanged at any time, as needs require. As herein illustrated, each said cavity intersects a passage within said base through which control fluid is directed to operate the valving element of the interrelated valve. As here provided, said control elements are inexpensive adapters having different configurations and different functional results in their use. They may be selectively applied within said cavities to selectively influence the delivery and mode of application of control fluid and thereby the means and/or mode of control of the operation of the valve to which they relate.

In any case the valve controls are separated, spaced and physically divorced from the body of the power valve and the valve unit itself is distinguished by a total absence of electrical wiring or its connection thereto.

Most preferred embodiments of said valve base incorporate electrical receptacles which are in direct communication with a wire gallery provided in the body thereof adjacent the cavities therein to which one or more of the aforementioned adapters are selectively and releasably quick fit.

Exemplary preferred forms of said adapters are quick release devices, herein demonstrated by way of example and not by way of limitation to comprise a solenoid adapter with which a solenoid interfits, a remote pilot adapter and an adapter the application of which insures a continuing flow of control fluid through said valve base to operatively relate to the valving element of the valve which mounts to said base.

A directional control valve system as well as any other comparable valve system per the present invention is distinguished by minimal electrical wiring and such electrical power as may be required for the operation thereof is directed to the valve base and isolated from the power valve which mounts thereto. This construction and arranged eliminates inadvisable wiring, chance damage thereto and the potential of electrical hazard frequently evidenced in use of power valve installations constructed in accordance with the teachings of the prior art.

The elements of a control section of a power valve installation per the present invention are not only divorced from the valve body but each element thereof may be independently serviced and quickly and easily interchanged without disturbing any wiring.

It is therefore a primary object of the invention to provide power valve systems, power valve assemblies and installations and components thereof which are not only economical to fabricate, assemble, disassemble and maintain but also more efficient and satisfactory in use and readily adaptable to a wide variety of applications.

Another object is to provide a power valve assembly which is highly improved as to its component structure and extremely safe in use.

A further object is to provide a new and improved valve base particularly advantageous for use in connection with power valve installations.

An additional object is to provide a new and improved valve base particularly advantageous for use in directional valve installations and systems thereof the construction and arrangement of which is such to distinctly separate the valve which it mounts from any direct connection thereto of its essential controls or applying thereto or therethrough any wiring which may be necessary for the supply thereto of power.

Another object is to provide a plurality of individual adapters which, singly or in combination, may be selectively and interchangeably quick fit to the valve base in a manner to facilitate the achievement of any one of a plurality of modes of control and/or operation of the valve which it mounts.

A further object is to provide a new and improved base for a directional control valve or the like formed with cavities for the plug fit thereto of selective of the aforementioned adapters, which cavities, at least in part, intersect flow passage(s) through which control fluid moves to the related valve to contribute to its function, in the process of which the flow of said fluid may be subjected to the influence of the application of one or more types of said adapters.

Another object is to provide a series of unique control units for use in connection with the valve base of a power valve assembly the nature and character of which enables an extremely simple and quick individual application and interchange thereof to achieve any one of a number of modes of control and operation of the valve which mounts to said base.

Another object of the invention is to provide power valve assemblies and respective components thereof exhibiting improvements over the prior art possessing the advantageous features of construction, the inherent meritorious characteristics and the means and mode of operation thereof herein described.

With the above and other incidental objects in view as will more fully appear in the present specification, the invention intended to be protected by Letters Patent consists of the features of construction, the parts and combinations thereof, and the means and mode of operation as herein described or illustrated in the accompanying drawings, or their equivalents. Referring to the accompanying drawings wherein are shown some but obviously not necessarily the only forms of embodiment of the invention, FIG. 1 is a plan view of the top of a valve base per the present invention;

Figure 4:
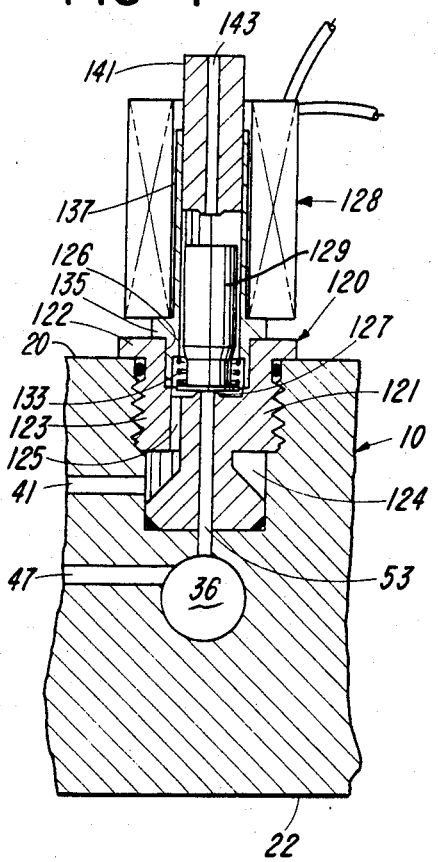
FIG. 4 is an enlarged view of a section of the valve base of FIG. 3 including the solenoid adapter of the present invention and essential components of an unenergized solenoid which mount thereto.
Figure 5:
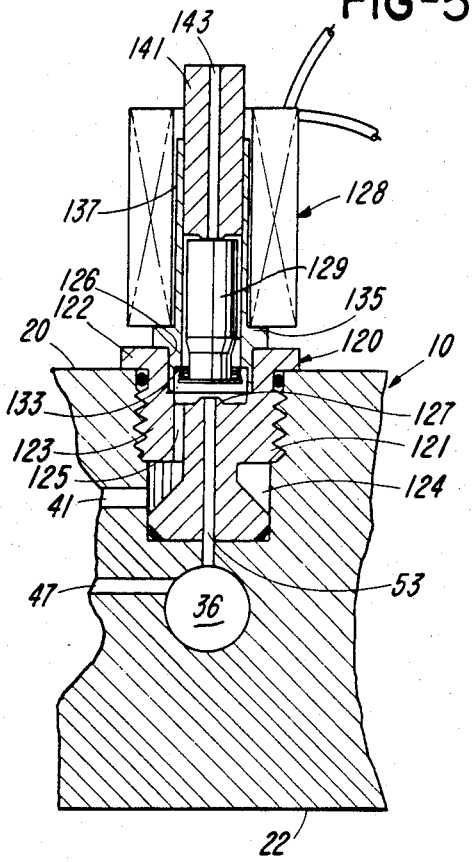
Figure 6:
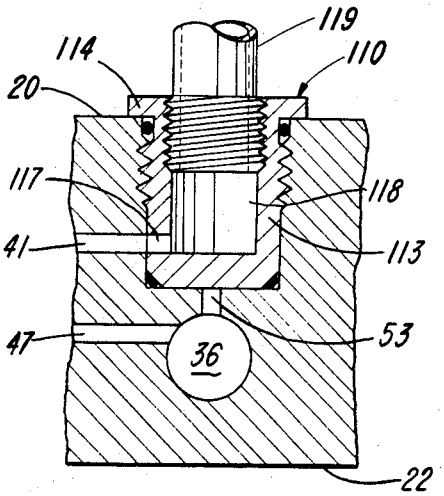
Figure 7:
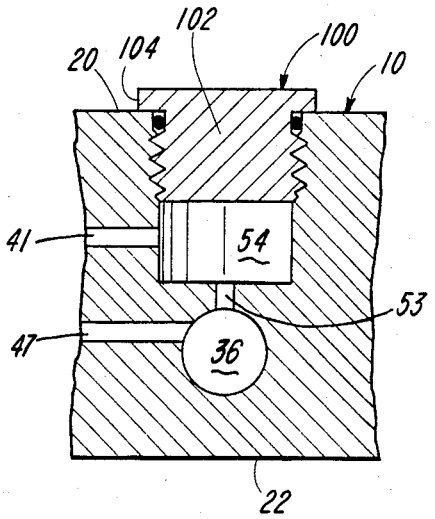

FIG. 5 exhibits FIG. 4 with the solenoid thereof in its energized condition;

FIG. 6 is a view similar to that shown in FIG. 4 wherein a remote pilot adapter is substituted for the solenoid adapter;

FIG. 7 corresponds to FIG. 6 except for the substitution therein of a third adapter the form of which insures a continuous application of control fluid to to a particular portion of the operating element of the valve which mounts to the valve base.

Figure 1:
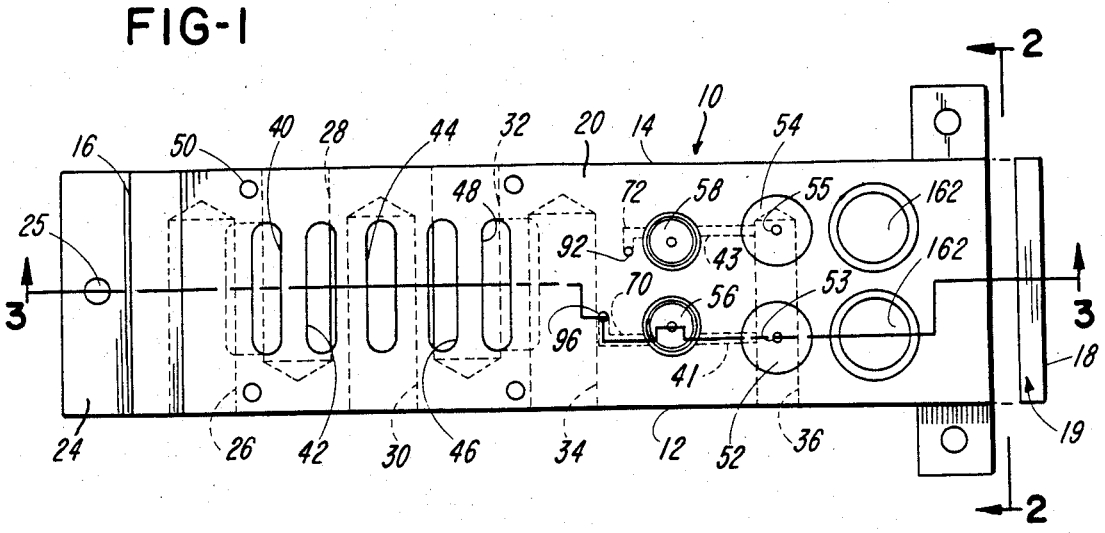
Figure 2:
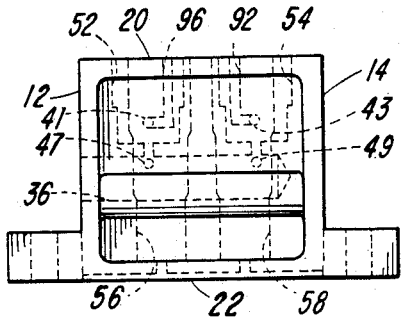
FIG. 2 is a view taken on line 2—2 of FIG. 1.
Figure 3:
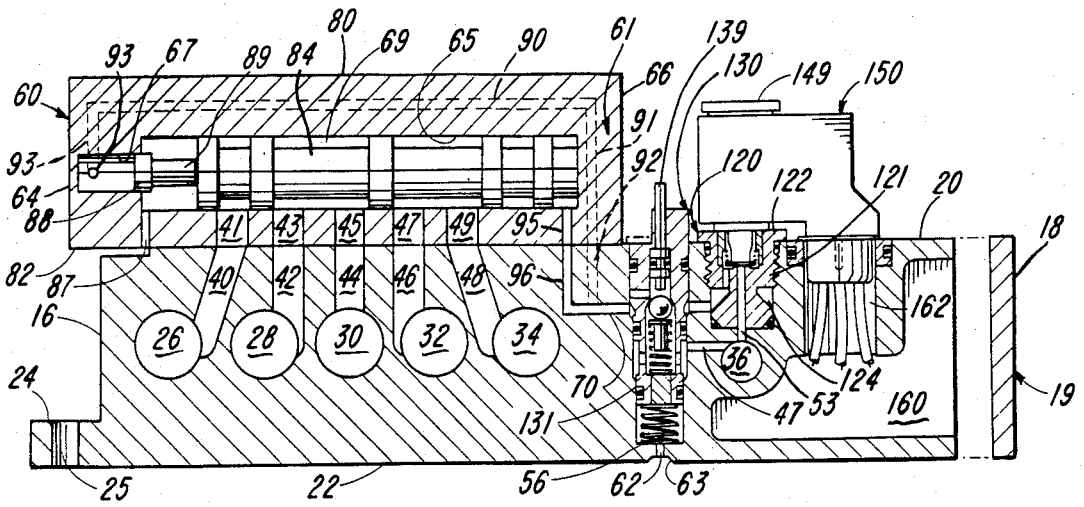
FIG. 3 is a vertical section of the longitudinal extent of of a power valve assembly including the valve base of FIG. 1, revealing a section on line 3—3 thereof and a portion of the control elements for the illustrated valve which have been selectively applied.
Figure 8:
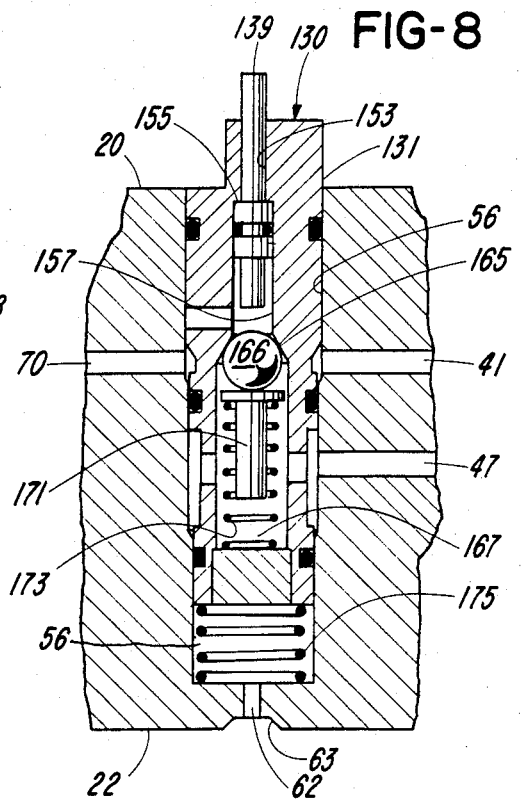
Figure 9:
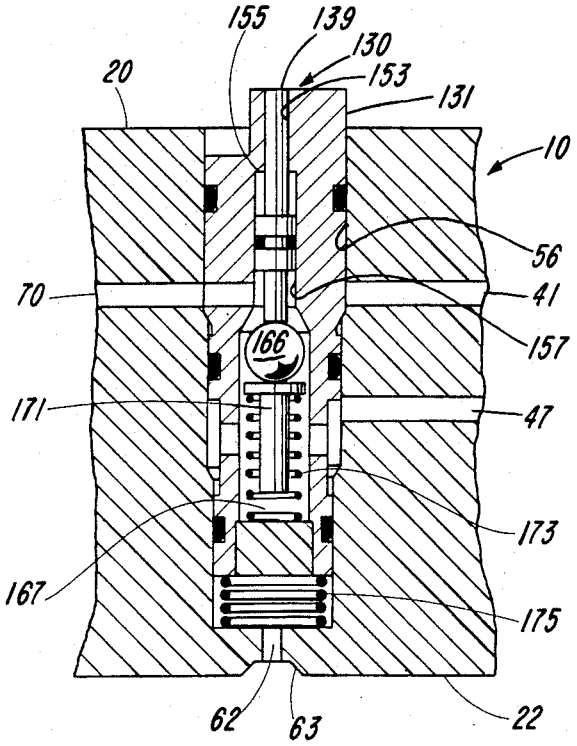
Figure 10:
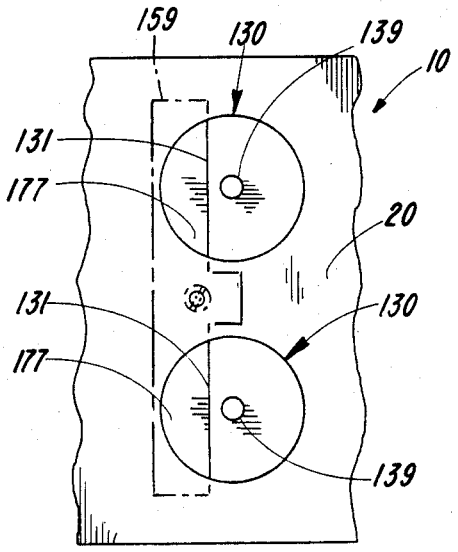
Figure 11:
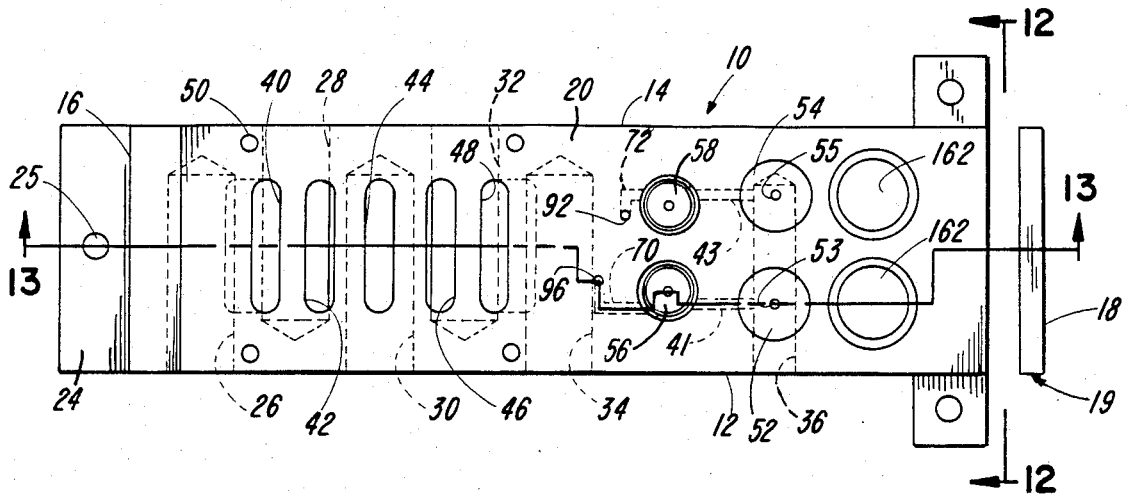
Figure 12:
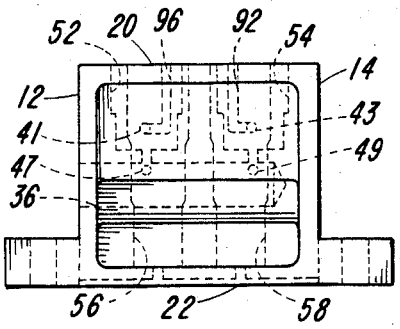
Figure 13:
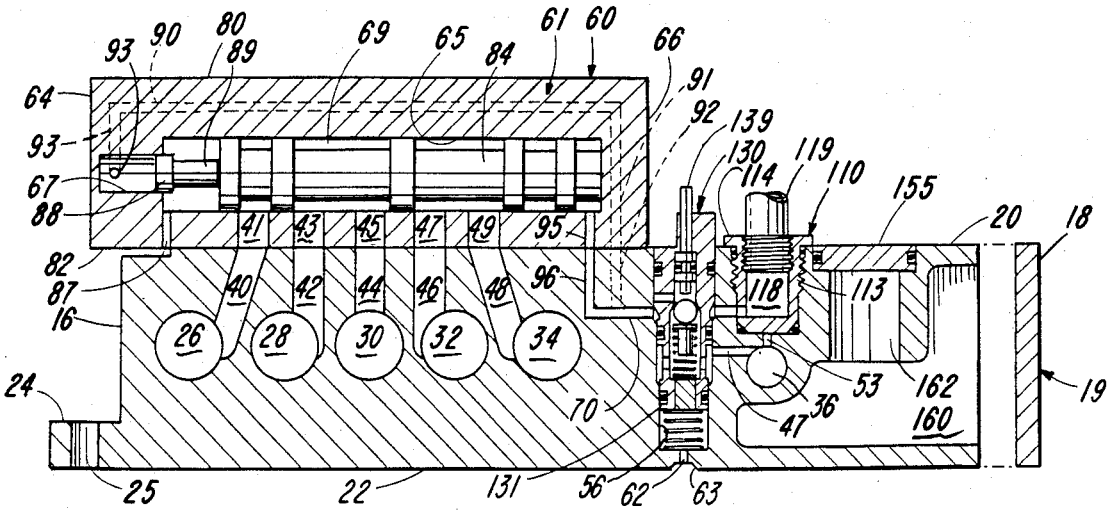
Figure 14:
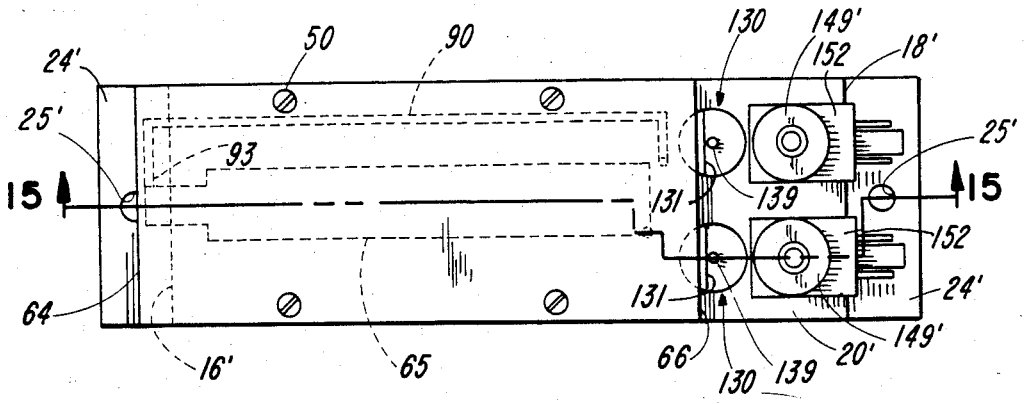
Figure 15:
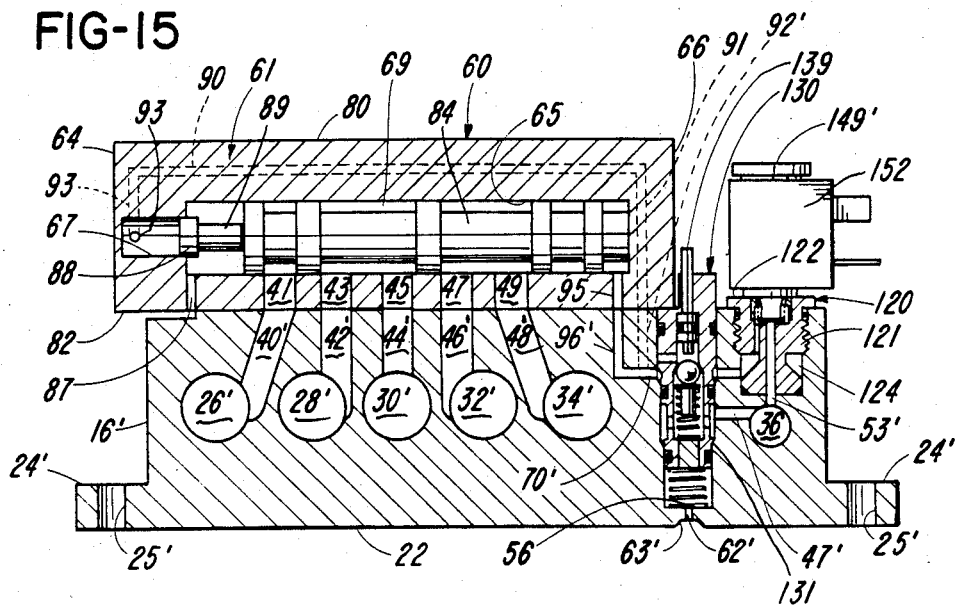
Figure 16:
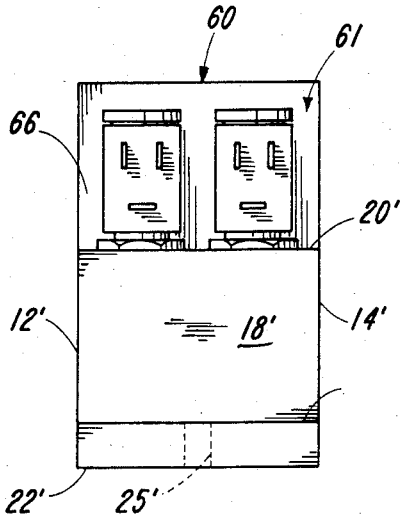
Figure 17:
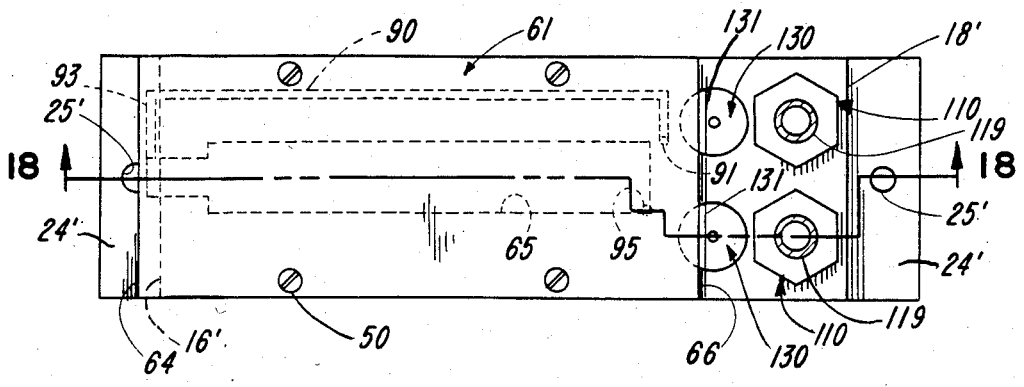
Figure 18:
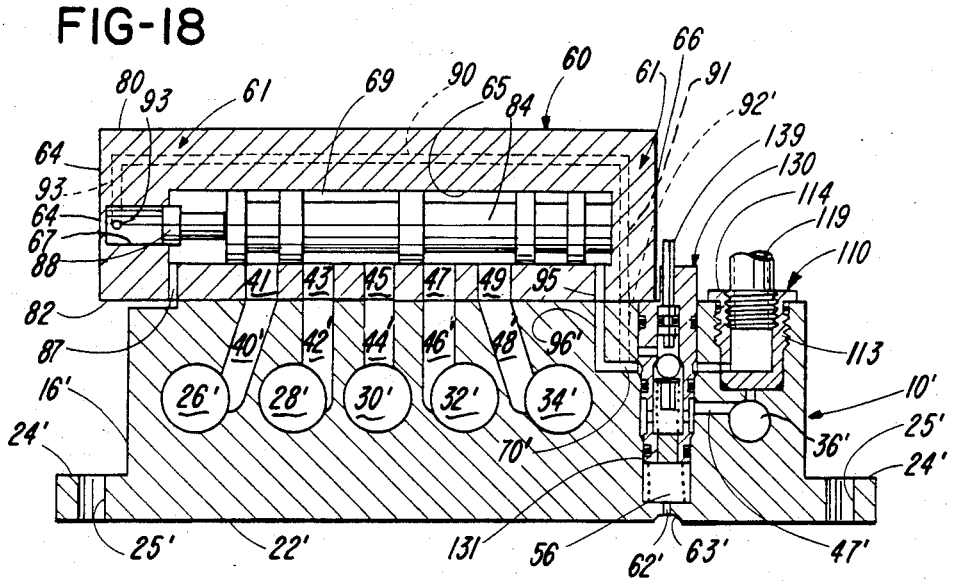
Figure 19:
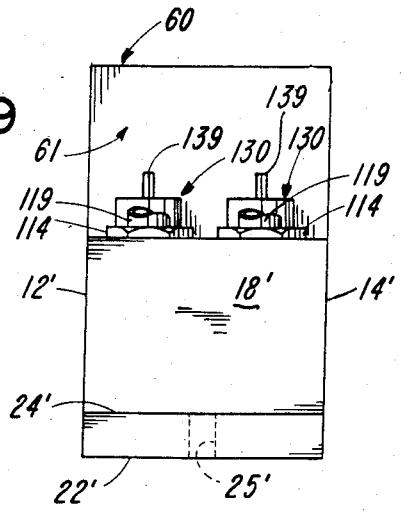

FIG. 8 is a view of another section of the valve base enlarged to better exhibit details fo the manual override device which is incorporated therein;

FIG. 9 shows the manual override device of FIG. 8 in an actuated condition;

FIG. 10 is a top view of that section of the valve base shown in FIGS. 8 and 9;

FIGS. 11–13 exhibit a modification of the power valve assembly of FIGS. 1–3 which occurs at such time the use of a solenoid is not required;

FIG. 14 is a plan view of the top of another power valve assembly featuring modifications of the valve base of FIG. 1;

FIG. 15 is a vertical section of the valve assembly of FIG. 14 taken on line 15—15 thereof;

FIG. 16 is an end view of the power valve assembly of FIGS. 14 and 15;

FIG. 17 is a plan view of the top of a further power valve assembly feature modifications of the valve base assembly of FIGS. 14–16;

FIG. 18 is a vertical section of the valve assembly of FIG. 17 taken on line 18—18 thereof;

FIG. 19 is an end view of the power valve assembly of FIGS. 17 and 18.

Like parts are identified by like numerals throughout the extent of the accompanying drawings.

A power valve assembly and system per the first illustrated embodiment (FIGS. 1–10) of the invention is distinguished by a valve base comprising an elongate generally rectangular block 10. For purpose of this disclosure and considering the manner of its use, the block 10 has a front surface 12, rear surface 14, side surfaces 16 and 18, top surface 20 and bottom surface 22. Surfaces 12 and 14 define the front to rear depth of the block 10 while its side surfaces 16 and 18, which run from front to rear, define its respective ends and its longitudinal extent. The right side surface 18 is defined by a separable end plate 19 secured by screws in capping relation to an opening from a chamber 160 formed in the adjacent end of the main body of the block 10. Left side surface 16 is stepped to provide thereon a perpendicular outwardly directed flange 24 at its bottom. At its end remote from the surface 16 the main body portion of the block 10 has laterally projected plate-like ears which are triangularly related to the flange 24. Said ears and the flange 24 each have a vertically oriented central aperture 25, which apertures commonly serve as means through which screws are applied to effect a secure and stable mount and attachment of the block 10 to an underlying support structure. A groove 63 in the surface 22 which extends from front to rear of the block 10 and perpendicular to the surface 12 and 14 is more closely adjacent the surface 18 than the surface 16 and parallel thereto.

The main body portion of the block 10 is provided with a series of five blind bores, three 26, 30 and 34 of which are directed inwardly of and perpendicular to its front surface 12 while the other two, 28 and 32, are directed inwardly of and perpendicular to its rear surface 14. These bores are parallel to each other and the surfaces 20 and 22, relatively closely spaced in a direction longitudinal of the block 10 and have a front to rear dimension the longitudinal extent of which is only slightly less than the corresponding dimension of the block 10. Bore 28 lies between bores 26 and 30, bore 32 between bores 30 and 34, bore 26 closely adjacent the side surface 16 and the bore 34 remote from bore 26 in substantially spaced relation to side surface 18.

A further blind bore 36 the diameter of which is relatively smaller than those of the bores 26, 28, 30, 32, 34 is directed inwardly of and perpendicular to the front surface 12, parallel to the surfaces 18 and 22 and over and in closely spaced relation to the innermost end portion of the chamber 160, which at this point is reduced in vertical depth with respect to the remainder thereof. The innermost limit of bore 36 is adjacent but spaced from the surface 14 of the block 10.

Five slots 40, 42, 46 and 48 are formed in and directed inwardly of the top surface 20 to open therefrom in lines which are parallel, closely spaced and commonly perpendicular to the surfaces 12 and 14. At their respective innermost ends, slot 40 opens to the bore 26, slot 42 to the bore 28, slot 44 to the bore 30, slot 46 to the bore 32 and slot 48 to the bore 34.

Four small diameter blind bores 50 which are tapped and directed inwardly of and perpendicular to the surface 20 are arranged in a rectangular pattern which frames the slots 40–48.

A spool type directional control valve 60 is mounted on the surface 20 of the block 10 to extend lengthwise thereof, in offset relation thereto, to have a relatively short end portion of its length project over and beyond the end surface 16 and its opposite end position short of and in a substantially spaced relation to the end surface 18.

Valve 60 comprises a generally rectangular block shaped housing 61 which, considering the its orientation seen in FIG. 3, exhibits a top surface 80, a left end surface 64, a right end surface 66 and a bottom surface 82.

Within the body of housing 61, extending substantially the length thereof, is a cylindrically configured chamber 69. Part of the length of this chamber is occupied by a spool type valve element 84. Spool 84 is formed to have longtiduinally spaced reduced diameter portions successively adjacent of which are spaced by larger diameter portions which bear on the wall of chamber 69 and form therewith a seal during cyclic shifting to spool 84 on operation of the valve. Note that spool 84 has a reduced diameter portion at its right and a larger diameter portion at its left end. The left end of chamber 69 is coaxially extended by a reduced diameter blind bore 67 the base of which is in adjacent, spaced, parallel relation to end surface 64. A piston 88 is housed in blind bore 67, in bearing relation to its bounding wall surface. A pin 89 formed integral and coaxial with piston 88 has its projected extremity extended in the direction of and coaxial with the adjacent end of the spool 84.

Valve housing 61 includes a vent passage 87 which opens at one end to the chamber 69 immediately of the entrance of bore 67 and at its other end from surface 82, to atmosphere, at the left end of the valve assembly, by way of a continuing passage formed between the surface 82 and the left end portion of surface 20 of valve base 10 immediately thereunder. Formed is and opening from the surface 82 of the housing 61 is a series of equidistantly spaced slots 41, 43, 45, 47 and 49, the spacing and size of which correspond to that of the slots 40, 42, 44, 46 and 48. The innermost ends of slots 41, 43, 45, 47 and 49 open to the bottom of chamber 69 within an area thereof substantially centered between and spaced from its respective ends.

In assembly of valve 60 to the block 10 its bottom surface 82 is so placed on the surface 20 to respectively align slots 41, 43, 45, 47 and 49 with slots 40, 42, 44, 46 and 48. At the same time four vertically oriented throughbores in the housing 61 are respectively paired and directly aligned with the bores 50 in the base 10, whereupon fasteners are applied through said throughbores and threadedly engaged in the bores 50 to fix the valve 60 to the block 10 and thereby secure the alignment of their respective slots.

The body of housing 61 has therein a very small diameter bore 90 directly over, spaced from the parallel to the chamber 69. The ends of bore 90 respectively extend beyond those of chamber 69. That end of bore 90 most adjacent end surface 64 opens to and communicates with the upper end of a bore 93 which is correspondingly small and perpendicularly related. The remote end of bore 93 is extended to open to the interior of bore 67 at its base end, behind the piston 88. The end of the bore 90 adjacent the surface 66 opens to one end of another perpendicularly related blind bore 91 in the housing 61 which opens from the bottom surface 82 of the valve 60 in direct alignment and communication with a blind bore 92 in the block 10. Bore 92 opens from the surface 20 and is directed inwardly thereof and perpendicular thereto.

A further blind bore 95 in housing 61 which is in parallel spaced relation to the bore 91 opens at one end from the bottom surface 82 of the valve 60 to be placed thereby in direct alignment and open communication with the upper end of a bore 96 directed inwardly of and perpendicular to the surface 20 of the block 10. The bore 96 is in a parallel spaced relation to the bore 92. The uppermost end of bore 95 opens into that end of the chamber 69 most adjacent surface 66 which is occupied by the reduced diameter end portion of spool 84, behind the annular shoulder defined by the following larger diameter portion thereof.

That end portion of the block 10 inclusive of the side surface 18 and clear of the bores 26–34, 92 and 96 and the valve 60 which seats thereon is provided with four additional blind bores 52, 54, 56 and 58, each of which is directed inwardly of and perpendicular to and defines a cavity in the top surface 20. Bores 52 and 54 are identical as to their axial length, directly above and spaced from the bore 36. Bore 52 is in immediately adjacent spaced relation to front surface 12 and has its central axis perpendicular to and intersecting the line of the central axis of bore 36. Bore 54 is adjacent and spaced from rear surface 14 and also has its central axis in a line perpendicular to the axis of bore 36. Each of the bores 52, 54 has a small diameter opening, respectively 53, 55, directed through the center of its base to communicate the cavity which it defines with the interior of the blind bore 36. Bores 52 and 54 have equal diameters and each have a limited portion of the axial length of its peripheral wall tapped to produce therein a threaded portion at that end thereof immediately of the surface 20.

Bores 56 and 58 are in adjacent closely spaced parallel relation to bores 52, 54 at that side thereof remote from surface 18; approximately twice the depth of and smaller in diameter than bores 52, 54 and have their central axes more closely adjacent each other than those of the bores 52, 54. Each of bores 56, 58 is twice reduced in diameter as it extends from surface 20 to its innermost limit adjacent but spaced from the surface 22. The stepped reduced in diameter in each bore 56, 58 forms two shoulders in its bounding wall surface. Both shoulders are narrow, brief in axial extent and conically convergent in a direction inwardly of the bore so that they face outwardly thereof. The axial distance between the shoulders and between each shoulder and the adjacent end of the bore in which they are formed is approximately equal.

A very small diameter bore 41 directed through an interior portion of the block 10 at a level adjacent and parallel to the surface 20 has one end thereof open to the cavity defined by bore 52 at a point immediately above and in spaced relation to its base. The other end of bore 41 opens into bore 56 immediately above the shoulder defining the first reduction of its diameter. A bore 43 identical to and at the same level as bore 41 similarly relates to the bores 54 and 58.

A bore 45 directed inwardly of the perpendicular to the top surface 20 at a location centered between bores 56 and 58 is tapped to accommodate a retention screw 57 the purpose of which will be further described.

Blind bores 96 and 92 are very small in diameter and respectively adjacent and in spaced parallel relation to the sides of bores 56, 58 remote from bores 52, 54. The lower end of bore 96 within the block 10 has a short lateral extension intersected by one extremity of a horizontally oriented very small diameter bore 70 the opposite extremity of which opens through the adjacent side of bore 56, to the cavity defined thereby, in outwardly offset relation to its central axis, to align with and normally form a continuation of the bore 41. A like bore 72 through the wall between bores 58 and 92 aligns with bore 43, opens at one end to the cavity defined by the bore 58, in outwardly offset relation to its central axis, and connects similarly to lower end of the bore 92.

Very small diameter bores 47, 49 directed through the body of the block 10 at a level spaced below that of the bores 41, 43 open at one end to the interior of the bore 36 and extend therefrom in spaced parallel relation to have their opposite ends open respectively to the interiors of bores 56 and 58 at a location between and spaced from the axially spaced shoulders in the respectively bounding walls thereof.

The outermost end portion of the wall bounding bore 36 is threaded and adapted for the coupling thereto of a line for the delivery therethrough of that control fluid which is required for the operation of valve 60. In most advantageous applications of the invention and said control fluid will be a gaseous fluid and should be so interpreted for the described embodiments.

The cavities defined by the bores 52 and 54 are each adapted to receive one of a variety of control members or devices per the present invention the nature and character of each of which is designed to influence, each in different manner, the means and mode of applying control fluid to and/or operating the valve which mounts to the block 10.

It should be clear that there may be numerous such control members or devices, each of which has a different effect in its application. However, only three are shown for purpose of illustrating exemplary embodiment of this invention. These comprise a blank adapter 100; a pilot adapter 110; and a solenoid adapter 120, all of which have characteristics of readily applied and readily removable plug-in devices. Note that for convenience of disclosure the selective application of these adapters is shown with reference to the same cavity in the block 10.

Adapter 100 comprises an externally threaded cylindrical body 102 having a short axial length and an intergral hexagonal head 104 the outer peripheral portion of which projects outwardly and radially of said body at what constitutes its outer end in use. This adapter as applied to a cavity in block 10 which is related to a particular flow passage wil dictate continuing and uninterrupted flow of control fluid through that passage which fluid is directed thereto by way of the port defined by bore 36.

As shown, pilot adapter 110 comprises a substantially cylindrical cup shaped element 113 the lip of which is distinguished by an outwardly directed radially projected annular flange 114 at what constitutes its outer end in use and a limited portion of the length of which, adjacent its head, is provided with an external radially projected thread. Its axial extent is somewhat greater than that of adapter 100 and its base is imperforate. The peripheral wall of the cup of element 113 features a radial aperture 117 therein adjacent its base which as adapter 113 is seated in a cavity such as 52 (FIG. 6), for example, aligns directly with and places the interior of the cup in open communication with bore 41. Since the base of cup 113 is imperforate, the application of this adapter to its cavity serves to block movement of control fluid from the bore 53 to the bore 41. As is self evident, bore 53 normally defines an upstream portion of the flow passage in block 10 which is further comprised of bores 41, 70 and 96. As seen in FIG. 6, the inner peripheral wall of the cup shaped element 113 is threaded for a short portion of its axial length at its outermost end to facilitate a quick coupling thereto of a conduit leading from a remote pilot. As will be obvious, adapter 110 may be readily applied to a cavity relating to a flow passage in block 10 to change the source of the control fluid which will be directed through the passage for use in operation of the related power valve.

The body 121 of solenoid adapter 120 is also generally cylindrical in configuration, has an integrally formed peripherally hexagonal head 122 at the end thereof outermost of the block 10 in use and an externally projected thread 123 over a portion of its axial length substantially immediately following said head. Beyond said thread, body 121 is reduced substantially in cross section for a short portion of its axial length to form in its outer periphery an annular groove 124 bounded on one side by a radial annular surface defined at the end of the threaded portion 123 and at the other side by a surface conically expanding in the direction of the end of body 121 remote from its head. Similar to adapter 110, the projected extremity of the body 121 has a brief conical convergent taper.

The body 121, which includes a central generally cylindrical pocket 126 directed inwardly of its head, has an axial throughbore one end of which opens from the center of the end thereof remote from its head and the other from the center of the base of said pocket. The latter opening is rimmed by a very short tubular lip 127 which projects inwardly of the pocket, perpendicular to its base. A further bore 125 extends though the body 121 parallel to its throughbore to open at its upper end (FIG. 4) through the base of said packet at a radial distance from its center slightly greater than that of the radial extent of its reduced diameter portion. The opposite end of bore 125 opens into the groove 124 immediately of its base. As adapter 120, so formed, is inserted in its cavity and seats to its base, it is threadedly but releasably engaged to its bounding wall, its throughbore defines a direct axial extension of the bore 53 and groove 24 is placed in open communication with the entrance to the bore 41.

The significance of adapter 120 may be particularly seen with reference to FIGS. 1–5 which detail the means and manner of utilizing the adapter to provide a safe and extremely quick connect-disconnect relation thereto of a solenoid 150. Ancillary thereto, the drawings illustrate simple and effective means in the block 10 for plugging the applied solenoid into a source of power simultaneously with its mount and connection to the adapter 120, which in this case is inserted in the cavity 52 in the block 10.

The invention contemplates an initial coupling of an armature assembly to the adapter 120, following which a solenoid coil need merely be slip fit thereto and connected to a source of power to provide an operative solenoid installation. The armature assembly is conventional and will be described only to the extent necessary for an understanding of the present invention. It comprises a housing in the form of a tubular metal sleeve 137 having an external radial flange 135 adjacent and spaced from one end thereof which is counterbored. For the coupling of the armature assembly to the adapter 120 a short portion of the length of sleeve 137 including said one end thereof is inserted in and has a complementary fit and threaded engagement to the wall bounding a counterbore of the pocket formed in the head of the adapter 120. The depth of insertion of said one end of sleeve 137 is determined by its abutment with a narrow annular shoulder formed by said pocket counterbore and a simultaneous seating of flange 135 to the outer surface portion of the adapter head which rims the opening to said pocket.

The armature assembly is further comprised of an armature 129 which is essentially contained in that end portion of the bore of sleeve 137 which positions lowermost as the assembly is applied to adapter 120. The outer shell of the armature is generally uniform and cylindrical in configuration but slightly necked and reduced in diameter immediately of its lowermost extremity which exhibits a radially projected flange. Positioned about said necked portion of the armature shell and between the outwardly facing shoulder formed by the counterbore in the lower end of sleeve 137 and the flange at the lower end of the armature is a coil spring 133 which in the assembled relation of the armature assembly biases the flanged end of the armature slightly out of the lower end of the sleeve causing it to abut and cap the opening rimmed by the tubular lip 127, thereby to cap the bore 53 and its extension and prevent flow of the control fluid to and downstream of the bore 41. Secured within the upper end of the sleeve 137 is a cylindrical body 141 which has a central axially directed throughbore providing a vent passage 143. The major portion of the length body 141, from which the armature is normally axially spaced, is fixedly retained within said sleeve while the remainder of its longitudinal extent projects upwardly, outwardly and beyond its upper end. As is conventionally provided, the armature 129 has a very small central aperture in its lower end bridged by a valve (not shown) which as its lower end seats and precludes flow of pressure fluid to bore 41 slightly opens and vents gaseous fluid through a passage suitably provided within said armature for the subsequent discharge thereof by way of the bore 143.

Figure 3A:
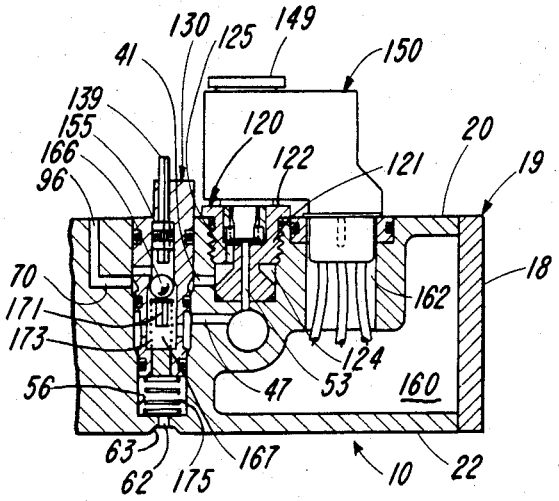
FIG. 3A is a view of a section of the valve base shown in FIG. 3, inclusive of the illustrated control elements.

FIGS. 3–5 show the solenoid adapter 120 applied to cavity 52 of block 10 and an armature assembly mounted to the adapter as above described and clearly evidence the ease at that point to slip fit to said adapter and armature assembly a solenoid coil and for that matter a housing to form with the coil a solenoid unit 150. As shown in FIGS. 3 and 3A the illustrated solenoid housing is laterally extended over the block 10 immediately to the right of cavity 52 and to a point more closely adjacent the side 18. In underlying relation to said extension is an electrical receptacle a peripheral flange of which is releasably seated in a counterbore of and in capping relation to an opening in the block defining a passage 162 to the interior of the chamber 160. The latter, in this instance, defines a wire gallery accommodating the wires connected to and leading from the receptacle for their connection to a source of electrical power. The FIGS. 3–5 further demonstrate that the wiring connected to coil 128 is housed in the lateral extension of solenoid housing 150 and connected in turn to conductive blade elements projected from and perpendicular to the bottom thereof to plug fit to the electrical receptacle simultaneously with the slip fit of the coil and its housing to provide a solenoid unit in connect with adapter 120. The arrangement provides a very quick, most simplistic and safe application of a solenoid to the base 10 as well as a most convenient connection of the solenoid to a power source. The foregoing reflects a most significant advance in the art to which the present invention relates.

Thus, at such time an operation of valve 60 is required, referenced to demand of control fluid to be delivered through the flow passage to which the solenoid 150 relates, this solenoid can be energized easily and safely. On such occurrence, viewing FIG. 5, the armature is induced, in obvious manner, to retract from its capping relation to the extension of bore 53 in the process of which the previously open valve therein inherently closes and the lower end portion of the armature compresses the spring 133 as it moves to cap the lower end of bore 143. As this occurs, there is a resulting flow of control fluid to the pocket in the head of adapter 120 by way of the bore 53 and its extension, which control fluid is forced to flow from this pocket to, downwardly and outwardly of bore 125 to groove 124 and from there to and through bore 41 and cavity 56, normally in bypassing relation to the override deivce 130 therein and subsequently to and through the bores 70, 96 and 95 to produce a required application thereof to the right end of spool 84 to achieve a required function. It should be obvious that in use of the adapter 120 and its interrelated solenoid that the solenoid is pulsed to energize at predetermined time spaced intervals.

It an installation preferably calls for the use of two opposed solenoids, a second solenoid adapter and armature and applied solenoid coil would be similarly releasably installed in connection with cavity 54 and would similarly function having reference to the flow passage comprised of bores 55, 43, cavity 58, and the override device therein, if any, bores 72, 92, 91 and 93.

Should a pulsing of control fluid be required to apply to each of several points or stages of a valving system, one need only add additional cavities in a block such as a block 10 and install appropriate adapters in each or any portion thereof as dictated by the desired means and more of operation of the related valve or valve system.

In case a continuous flow of control fluid through a particular flow passage may be required throughout a valve operation, an adapter 100 should be installed in that or each of those cavities which intersect such flow passage(s).

At the same time, where a situation makes it apparent remote solenoid control and/or a different source of fluid or different pressured fluid is advisable with reference to one or more flow passages in a system such as herein described one would then apply an adapter 110 to that or those cavities intersecting the pertinent flow passage(s).

A further adapter unit 130 for insertion in the block 10 is seen in FIGS. 1–3 and particularly detailed in FIGS. 8–10. One such unit, constituting a manual override device, is inserted in each of the cavities 56 and 58 of the block 10. This unit comprises a sleeve 131 having an axial length approximately that of cavities 56 and 58 and an outer peripheral configuration the length thereof which is complementary to to that of the peripherally bounding wall of the cavities to which it applies and provides it with a slip friction fit in its assembly to the block 10.

Unit 130 is further described in detail with reference to its installed position in cavity 56. Its relation to cavity 58 and the flow passage to which this cavity relates is identical.

As seen, the lower end of the bore of sleeve 131 has a closure. In the installation of unit 130 in cavity 56 this closed end thereof is based on the upper end of a previously inserted coil spring 175 and the lower end of which is firmly seated to the cavity base substantially concentric to the vent aperture 62 which is formed therein. The bore sleeve 131 from its upper and outermost end, which is open, to said closure is stepped as to its diameter, which is smallest within a short portion 153 of its length the major extent of which is biased upwardly from the surface 20 of block 10 until the override unit 130 is actuated. The innermost limit of portion 153 is defined by a narrow annular radial shoulder 155 which faces the closed end of the bore. The outer radial limit of shoulder 155 determines the uniform diameter of the following somewhat longer bore portion 157. The latter is followed by further expansion of the bore producing in its bounding wall a short conically expanding transition surface 165 the maximum diameter of which is maintained for the remainder the length of the bore. The transition surface 165 is shaped to complementary to and to seat thereon a ball bearing element 166 which seats in turn on the upper surface of the expanded head portion of a pin 171. The head of pin 171 is based on the upper end of a spring 173 the lower end of which is seated on the closure at the lower end of the bore. The body of pin 171 depends from its resiliently supported head within a short portion of the length of spring 173, in stabilizing relation thereto. The spring 173 which is somewhat weaker than the spring 175 normally maintains a bais on the ball 166 to close the bore as long as the override device is unactuated.

A control pin 139 located in the upper end portion of the bore of sleeve 131 has a uniform diameter which corresponds to the diameter of the bore section 153, except for a short portion of its length adjacent and spaced from its innermost end which forms thereon oppositely facing annular shoulders. This expanded diameter portion of the pin 139 has a circumferentially extending groove in its outer surface which partially nests a sealing ring. In the unactuated position on pin 139, the upper and major portion of its length projects through the bore section 153 to have a limited segment thereof project upwardly and outwardly of the upper end of the sleeve 131. At the same time the lower portion of this control pin positions within the bore section 157 to have the uppermost shoulder of its expanded diameter portion immediately of the shouder 155.

The outer surface of the sleeve 131 also has a series of circumferentially extending grooves each of which partially nests a sealing ring. As shown in FIGS. 8 and 9 these sealing rings are equidistantly spaced in a direction longitudinally of the sleeve and in the application of the sleeve within the cavity 56 achieve a sealing, bearing frictional engagement with the bounding wall thereof. A first radial bore formed in sleeve 131 opens at one end to the bore 157 immediately above the seat 165 for bearing 166 and at its other end through the outer surface of the sleeve. As seen in the FIG. 8, this radial bore is at the side of the sleeve adjacent the opening to bore 70 and, in the unactuated condition of the device 130 displaced upwardly therefrom. At the same time a groove circumferentially of and in the outer surface of sleeve 131 at the level of the transition surface 165 aligns with bores 41 and 70 and by virtue of this circumstance there is at this point free and open communication for flow of control fluid from the bore 41 to the bore 70 in bypassing relation to the override device. Additional radial bores in the body of sleeve 131, at a common level below and spaced from transition surface 165, open at their inner ends to the bore section 167 intermediate its axial limits and at their outer ends to a further groove in and circumferentially of the outer surface of sleeve 131 opening into the upstream side of which is the downstream end of bore 47.

Noting FIG. 8, a segment of the upper and outwardly projected portion of sleeve 131 at the side thereof remote from the cavity 52 is removed to form on the outer end thereof a rectangular vertical surface which orients perpendicular to the surface 20, is parallel to the end surface 18 of the block 10 and spaced from and to the side of the control pin 139 remote therefrom and in addition thereto a horizontal surface which in the unactuated condition of device 130 is substantially coplanar with the surface 20.

As will be seen from FIG. 1, and as has been mentioned previously, the central vertical axes of the override devices 130, which in this instance are applied to each of cavities 56 and 58, are more closely adjacent than those of adapters applied to the cavities 52 and 54 (in this case solenoid adapters). As a result, the normal lines of flow of control fluid through the respective flow passages of which bores 41 and 43 respectively form a part are respectively offset to outer peripheral portions of the respective cavities 56, 58. Thus, as long as the override devices 130 are not actuated (FIG. 8), flow of control fluid to the valve 60 will be uninterrupted in moving through the respective flow passage referred to. At the same time, as seen in FIG. 8, the seating of ball 166 to its seat 165 in the bore of sleeve 131 which seat is spaced below the upper radial aperture in the sleeve which opens to the bore section 157 insures that control fluid directed through bore 47 will be blocked from passage to the downstream segment of the normal flow passage including that portion thereof defined by bore 70. The same applies to the relation of the unactuated override member provided in the cavity 58 to the portions of the flow passages in the block 10 which are related thereto.

If for example some problem should develop in an upstream portion of a flow passage including that part provided by the bore 41 or bore 43, for example the bore 41, all one need do to overcome this problem is to depress the control pin 139 and the sleeve 131, the latter against the bias of spring 175 and the former against the bias of the relatively weaker spring 173 to provide thereby an alignment of the radial bore in the sleeve 131 communicating with the bore section 157 with the downstream bore 70 and simultaneously therewith a displacement of the bearing element 166 from the seat 165. The result of this is a direct communication of supplemental bore 47 with bore 70, control fluid in bore 47 being then enabled to pass therefrom to the groove in the outer wall of sleeve 131 about the aperture or apertures communicating with the bore section 167 and from there upwardly about the bearing 166 to the bore section 157 and by way of the radial aperture communicating therewith to and through the then aligned bore 70 and the bore defining an extension thereof to that point where the control fluid so moving is applied to the operation of the valve spool 84.

Reference is made to FIG. 10 of the drawings which is a top view of the segment of the block 10 including the override devices. This figure illustrates, where so required, the use of a retention bar 159 overlying the cutback horizontal surface portions at the outer end of the override devices 130, which bar is connected to the block surface 20 by an applied screw. This is simply an additional safety measure.

FIGS. 11 through 13 show the construction of FIGS. 1–10 with some limited modifications. This power valve assembly is one which is not employing the solenoid adapter 120, under which circumstances, a blank 155 has been substituted for the electrical receptacle illustrated in FIG. 3, the same being readily applied and replaced in a manner believed obvious. In addition, FIG. 13 demonstrates, in connection with the block 10, the use of the pilot adapter 110 the nature and character of which has been heretofore described in detail. As should be obvious from the foregoing detailed description related to FIGs. 1–10 and the component construction therein described in detail and with reference to their function, the assembly of FIGS. 11–13 can be similarly utilized and similarly function, the function being determined by a selective use of the quick fit and quick release adapters and adapting control units as prescribed by the present invention.

FIGS. 14–16 exhibit another modification of the assembly of FIGS. 1–10 wherein a somewhat less preferred construction is provided in that the chamber 160 and the plug-in features for the solenoids (s) have been eliminated. In this case the solenoid coil and its housing are applied to the adapter 120 and the armature applied to the adapter in the same fashion as described in the first instance, the difference being in the nature of the solenoids, the plug-in blades of which are immediately and outwardly of the end or side surface 18' of the base remote from the valve 60. As will be obvious in such event a receptacle in connection with a lead lie from a source of power can be simply and readily provided for the solenoid(s). The obvious benefits of the solenoid adapter and its assembly remain.

In any case, the availability of simple and highly efficient and effective use of plug in adapters including the override control units per the present invention and the ability by reason thereof to achieve simply and inexpensively a wide variety of modes of operation of power valves with a high degree of safety in their use, during which they are supported solely by the valve base and the ability provided by the present invention to divorce electrical connections from the valves per se afford a valve assembly which exhibits a significant advance in the art.

One further option demonstrated in FIG. 15 resulting in a difference from the assembly of FIGS. 1–3, as an alternative to use of the retention bar 159, is a modification in dimension and form of the block 10 to mount valve 60 so that the end of the valve remote from the base surface 16' slightly overlaps the cut back horizontal portions of the outer ends of the applied override devices.

FIGS. 17–19 differ from the showing and substance of FIGS. 14–16 only in respect to the demonstration of the use of adapters such as the adapter 110 rather than solenoid adapters in the case of an application where the use of the same is not desirable.

Consider the versatility of the apparatus described, enabled by selective application of various independently provided controls which are in the form of adapters easily and quickly interfit to the valve base. Note, in particular, that there is no need for any physical connection of the adapters per se to the valve the function of which they control.

As will be seen from the sum and total of the foregoing by those versed in the art, the present invention includes features of novelty which inherently solve a number of problems and eliminate significant complexities evidenced and inherent in the apparatus of the prior art as first stated. Moreover, important benefits of the invention are otherwise exemplified thereby resulting a minimalization of capital investment in the use of power valve assemblies. Also inherent in the use of the invention apparatus is a minimalization of time and cost of inspection and maintenance procedures in dealing therewith.

From the above description it will be apparent that there is thus provided a device of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or priviledge is claimed are defined as follows:

1. Apparatus for use in controlling the operation of power valve assemblies or the like and systems thereof comprising means defining structure a portion of which serves as a valve base and another portion of which defines an extension of said valve base which is clear of that valve which it mounts in use thereof, said extension having therein a plurality of flow passages for the delivery therethrough and the direction therefrom a pressured flow of control fluid which is to be applied to control the operation of such valve as may be mounted to said valve base, said extension having an exterior surface portion opening from which are cavities which are directed inwardly thereof, at least a portion of said cavities being arranged to selectively intersect said flow passages within said extension and means selectively applied to said portion of said cavities at said exterior surface portion of said extension which are constructed and arranged, at least in part, to selectively influence and determine the movement of said control fluid in those passages to which said cavities relate thereby to determine and provide a selective means for and mode of control of the operation of the valve to which the control fluid delivered from said flow passages applies.

2. Apparatus as in claim 1 wherein said means selectively applied to said cavities are interchangeable, at least in part, as to the cavities to which they apply, to produce a selective change in the pattern of movement of control fluid through said flow passages and the means and mode of operation of the valve to which said control fluid is applied.

3. Apparatus as in claim 2 wherein at least one of said means selectively applied to said cavities is so formed to friction fit in the cavity to which it applies.

4. Apparatus as in claim 2 wherein said means selectively applied to said cavities comprise at least part of a plurality of adapters having distinctively different constructions each of which determines a different mode of operation of the related valve.

5. Apparatus as in claim 4 wherein at least one of said adapters is a solenoid adapter which has a readily releasable but secure application to the cavity to which it applies.

6. Apparatus as in claim 5 wherein said solenoid adapter mounts an armature unit at least a portion of which projects outwardly therefrom and the cavity to which it applies and outwardly from said exterior surface portion of said extension and said armature has a slip fit readily detachable coil which forms therewith a solenoid assembly.

7. Apparatus as in claim 6 wherein said extension includes therein a chamber providing an electrical wire gallery which is separated from and clear of said portion of said cavities and said flow passages and said chamber has an opening therefrom at said exterior surface of said extension which is bridged by means defining a selected number of electrical receptacles located adjacent a portion of said cavities to which a solenoid adapter applies and said receptacle has electrical wiring within said chamber connected therewith and connectable to a source of power thereby to facilitate a quick mount of a solenoid assembly to said solenoid adapter and simultaneously therewith a connection of the solenoid assembly to a source of power.

8. Apparatus as in claim 1 wherein said means selectively applied to said portion of said cavities include and spring biased manual override device which has a friction fit in the cavity to which it applies.

9. Apparatus as in claim 1 wherein a portion of said extension remote from said valve base has a single inlet passage for the delivery therethrough a pressured flow of control fluid, from a suitable source, to and through said passages as and to the extent dictated by the form and nature of said means selectively applied to said portion of said cavities.

10. Apparatus as in claim 9 characterized in that at least one of said means selectively appplied to said portion of said cavities is an adapter formed in the application thereof to one of said cavities to position in blocking relation to the upstream portion of the flow passage which it intersects and providing means for the connection thereto of a different source of a flow of control fluid under pressure and means for delivering such pressure fluid to the downstream portion of the flow passage which it intersects.

11. Apparatus as in claim 1 wherein at least one of said means selectively applied to said portion of said cavities is a releasable means the construction and application of which is such to dictate a normal continuous flow of control fluid through the flow passage intersected by the cavity to which it applies.

12. Apparatus as in claim 1 wherein said structure is an integrated structure having the form of an elongate generally rectangular block the valve base portion of which is offset to one end of its length and said means selectively applied to said portion of said cavities are located adjacent the opposite end of its length.

13. Apparatus for use in connection with power valve assemblies and the like and systems thereof comprising means defining a valve base including a portion which is adapted to mount a valve and an extension thereof which positions outwardly from the valve which it mounts, said extension being formed to receive and transmit therethrough a pressured flow of control fluid for the delivery and application thereof to control the operation of whatever valve may be mounted to said portion of said base at the time of such flow, and means mounting to said extension of said base constructed and arranged, at least in part, to selectively influence and determine the course of said flow and dictate the means and mode of control and operation of that valve which is mounted to said portion of said base at the time of said flow, said last named means being physically separated and apart from that valve which depends for its operation on the application thereof of said control fluid, said valve base and said extension thereof being integrated and having the form of an elongate generally rectangular block the valve mounting portion of which is offset to one end of its length and said last mentioned means being located adjacent the opposite end of said length of said base.

14. Apparatus as in claim 13 characterized in that at least a portion of said means mounted to said extension of said base is constructed and arranged for the connection thereto and the delivery therethrough of a pressure flow of control fluid from a different source for the transmission and application thereof by way of said extension to control the operation of whatever valve may be mounted to said portion of said base at the time of such flow.

15. Apparatus for use in connection with power valve assemblies and the like and systems thereof comprising means defining a valve base including a portion which is adapted to mount a valve and an extension thereof which positions outwardly from the valve which it mounts, said extension being formed to receive and transmit therethrough a pressured flow of control fluid for the delivery and application thereof control the operation of whatever valve may be mounted to said portion of said base at the time of such flow, and means mounting to said extension of said base constructed and arranged, at least in part, to selectively influence and determine the course of said flow and dictate the means and mode of control and operation of that valve which is mounted to said portion of said base at the time of said flow, said last named means being physically separated and apart from that valve which depends for its operation on the application thereto of said control fluid, said extension of said base being formed with a plurality of cavities and said last named means comprising part of a plurality of adapters at least a portion of which may be selectively, releasably and interchangeably inserted in said cavities, at least in part, as and when required.

16. Apparatus as in claim 15 wherein said extension is provided with a plurality of passages to direct and transmit therethrough said pressured flow of valve control fluid and said cavities are intersected by at least one of said passages.

17. Apparatus as in claim 16 wherein at least one of said adapters applied to one of said cavities intersecting one of said passages is constructed and arranged to provide for the connection thereto of a remote pilot for the delivery therethrough of a pressured flow of valve control fluid to said one of said passages to provide for a directed control of the fluid transmitted through said one passage and correspondingly a so directed control of the operation of the related valve to which this fluid is applied.

18. Apparatus as in claim 16 wherein at least one of said cavities is intersected by two of said passages at relatively spaced locations along its depth and a spring biased manual override control device which is applied to this cavity has a quick release friction fit thereto.

19. Apparatus as in claim 15 wherein at least one of said adapters applied to one of said cavities is a solenoid adapter.

20. Apparatus as in claim 19 wherein said solenoid adapter releasably mounts on armature to which the coil of a solenoid assembly of which it forms a part has a slip fit relation to provide for a quick connect disconnect relation of said coil to said solenoid adapter.

21. Apparatus as in claim 20 wherein said extension includes therein a chamber providing an electrical wire gallery which is separated from and clear of said portion of said cavities and said flow passages and said chamber has an opening thereform at an exterior surface portion of said extension which is bridged by means defining a selected number of electrical receptacles located adjacent a portion of said cavities to which said solenoid adapter applies and said receptacle has electrical wiring within said chamber connected therewith and connectable to a source of power thereby to facilitate a quick mount of a solenoid assembly to said solenoid adapter and simultaneously therewith a connection of the solenoid assembly to a source of power.

22. Apparatus for use in connection with power valve assemblies and the like and systems thereof comprising means defining a valve base including a portion which is adapted to mount a valve and an extension thereof which positions outwardly from the valve which it mounts, said extension being formed to receive and transmit therethrough a pressured flow of control fluid for the delivery and application thereof to control the operation of whatever valve may be mounted to said portion of said base at the time of such flow, and means mounting to said extension of said base constructed and arranged, at least in part, to selectively influence and determine the course of said flow and dictate the means and mode of control and operation of that valve which is mounted to said portion of said base at the time of said flow, said last named means being physically separated and part from that valve which depends for its operation on the application thereto of said control fluid, said means defining a valve base including said portion thereof adapted to mount a valve and said extension thereof forming parts of a block having an elongate generally rectangular form, said portion of said means defining a valve base adapted to mount a valve being offset to one end portion of the length of said block and being formed to provide therein a path for working fluid to move through and from said base, by way of the valve which mounts thereto, for a directed cycling of working fluid to and from a selected point of use and said path for said working fluid being spaced from and clear of said extension.

* * * * *

UNITED STATES PATENT AND TRADEMARK OFFICE

CERTIFICATE OF CORRECTION

PATENT NO. : 4,726,393

DATED : February 23, 1988

INVENTOR(S) : Ray H. Herner

It is certified that error appears in the above-identified patent and that said Letters Patent is hereby corrected as shown below:

Col. 1, line 9, "comprenhesive" is corrected to read -- comprehensive --.

Col. 1, line 57, "substantially" is corrected to read -- substantively --.

Col. 4, line 5, "fo" is corrected to read -- of --.

Col. 4, line 22, "feature" is corrected to read -- featuring --.

Col. 5, line 13, -- 44 -- is inserted following "42,".

Col. 5, line 38, "valve" is amended to read -- valving --.

Col. 5, line 39, "longtiduinally" is corrected to read -- longitudinally --.

Col. 5, line 48, delete "is".

Col. 5, line 55, "of" is corrected to read -- to --.

Col. 5, line 59, "is" is corrected to read -- in --.

UNITED STATES PATENT AND TRADEMARK OFFICE

CERTIFICATE OF CORRECTION

PATENT NO. : 4,726,393

DATED : February 23, 1988

INVENTOR(S) : Ray H. Herner

It is certified that error appears in the above-identified patent and that said Letters Patent is hereby corrected as shown below:

Col. 6, line 5, -- suitable -- is inserted following "whereupon".

Col. 6, line 65, "reduced" is corrected to read -- reduction --.

Col. 7, line 14, "45" is deleted

Col. 7, line 14, "the" should read -- and --.

Col. 7, line 44, delete "and".

Col. 7, line 58, "embodiment" is corrected to read -- embodiments --.

Col. 8, line 3, "wil" is corrected to read -- will --.

Col. 8, line 49, "conical" is corrected to read -- conically --.

Col. 8, line 59, "packet" is corrected to read -- pocket --.

Col. 10, line 19, "connect" is corrected to read -- connection --.

Col. 10, line 44, "deivce" is corrected to read -- device --.

Col. 10, line 51, "It" is corrected to read -- If --.

Col. 10, line 63, "more" is corrected to read -- mode --.

Col. 11, line 43, -- be -- is inserted following "to".

Col. 11, line 53, "bais" is corrected to read -- bias --.

UNITED STATES PATENT AND TRADEMARK OFFICE

CERTIFICATE OF CORRECTION

PATENT NO. : 4,726,393

DATED : February 23, 1988

INVENTOR(S) : Ray H. Herner

It is certified that error appears in the above-identified patent and that said Letters Patent is hereby corrected as shown below:

Col. 12, line 2, "shouder"is corrected to read -- shoulder --.

Col. 12, line 11, -- section -- is inserted following "bore".

Col. 12, line 52, "passage" is corrected to read -- passages --.

Col. 12, line 64, "example" is corrected to read --
-- any reason --.

Col. 13, line 15, "bore" is corrected to read -- bores --.

Col. 13, line 48, "solenoids (s)" is corrected to read --
-- solenoid(s) --.

Col. 14, line 62 (Claim 1, line 8) -- of -- is inserted
following "therefrom".

Col. 15, line 50,(Claim 8, line 2) "and" is corrected to read --
-- a --.

Col. 15, line 56, (Claim 9, line 3), -- of -- is inserted
following "therethrough".

UNITED STATES PATENT AND TRADEMARK OFFICE

CERTIFICATE OF CORRECTION

PATENT NO. : 4,726,393

DATED : February 23, 1988

INVENTOR(S) : Ray H. Herner

It is certified that error appears in the above-identified patent and that said Letters Patent is hereby corrected as shown below:

Col. 16, line 55 (Claim 15, line 8) insert -- to -- following "thereof".

Col. 18, line 24 (Claim 22, line 17) "part" is corrected to read -- apart --.

Signed and Sealed this

Thirteenth Day of September, 1988

*Attest:*

DONALD J. QUIGG

*Attesting Officer*

*Commissioner of Patents and Trademarks*